US008814456B2

(12) United States Patent
Schultz et al.

(10) Patent No.: US 8,814,456 B2
(45) Date of Patent: Aug. 26, 2014

(54) APPLICATOR FOR AUTOMATICALLY DISPENSING SELF-ADHESIVE PRODUCTS

(75) Inventors: Jeffrey A. Schultz, Racine, WI (US); Michael E. Klinkhammer, Racine, WI (US); Steven A. Zach, Waterford, WI (US); Russell B. Wortley, Kenosha, WI (US); William J. Rice, Antioch, IL (US); Doraiswami Jaichandra, Racine, WI (US); Mark D. Duennes, Wheeling, IL (US); Keith C. Kristiansen, Stratford, CT (US); Jeffrey E. Butler, Jr., Edgewater, NJ (US); Thomas Van Dyk, Ramsey, NJ (US); David A. Demar, Tenafly, NY (US); Roland Charriez, Plattekill, NY (US); John Kiely, Morris Plains, NJ (US); John Anastasiadis, Tinton Falls, NJ (US)

(73) Assignee: S.C. Johnson & Son, Inc., Racine, WI (US)

( * ) Notice: Subject to any disclaimer, the term of this patent is extended or adjusted under 35 U.S.C. 154(b) by 246 days.

(21) Appl. No.: 12/723,404

(22) Filed: Mar. 12, 2010
(Under 37 CFR 1.47)

(65) Prior Publication Data

US 2011/0017406 A1 Jan. 27, 2011

Related U.S. Application Data

(63) Continuation-in-part of application No. 12/388,588, filed on Feb. 19, 2009, now abandoned.

(51) Int. Cl.

| | |
|---|---|
| ***B43M 11/02*** | (2006.01) |
| ***C11D 17/00*** | (2006.01) |
| ***E03D 9/00*** | (2006.01) |
| ***B65D 83/00*** | (2006.01) |
| ***C11D 17/04*** | (2006.01) |
| *E03D 9/02* | (2006.01) |

(52) U.S. Cl.

CPC ..... *C11D 17/041* (2013.01); *C11D 17/0056* (2013.01); *E03D 9/005* (2013.01); *B65D 83/0022* (2013.01); *C11D 17/003* (2013.01); *E03D 2009/024* (2013.01)

USPC ..... 401/137; 401/149; 401/179; 222/471

(58) Field of Classification Search

USPC ..... 401/176, 179, 137, 150, 182, 65–66, 401/88, 149; 222/471, 525, 391

See application file for complete search history.

(56) References Cited

U.S. PATENT DOCUMENTS 3,215,320 A * 11/1965 Heisler et al. ..... 222/391
3,790,048 A 2/1974 Luciano et al.

(Continued)

FOREIGN PATENT DOCUMENTS

FR 1596074 A 6/1970
FR 2509980 A1 1/1983

(Continued)

OTHER PUBLICATIONS

PCT/US2011/000445 International Search Report dated Jun. 29, 2011.

*Primary Examiner* — David Walczak
*Assistant Examiner* — Bradley Oliver

(57) ABSTRACT

A device employed by a user for applying a self-adhesive product to a surface may include an outer housing configured for gripping by a single hand of the user, the outer housing having a distal end, and a volume of self-adhesive product disposed within the outer housing. An automatic dispensing mechanism is disposed within the outer housing and operatively coupled to the outer housing and the volume of self-adhesive product, the automatic dispensing mechanism configured to advance at least a portion of the volume of self-adhesive product through the outer housing distal end in response to a manual actuation force applied to the outer housing.

10 Claims, 7 Drawing Sheets

(56) References Cited

U.S. PATENT DOCUMENTS

| | | | | |
|---|---|---|---|---|
| 4,413,760 | A | 11/1983 | Paton | |
| 4,892,427 | A * | 1/1990 | Ford | 401/182 |
| 4,955,747 | A | 9/1990 | Tarver | |
| 5,020,693 | A | 6/1991 | Ernst et al. | |
| 5,421,663 | A | 6/1995 | Bravo | |
| 5,588,560 | A | 12/1996 | Benedict et al. | |
| 5,636,933 | A | 6/1997 | Vizsolyi | |
| 6,159,181 | A | 12/2000 | Crossman et al. | |
| 6,357,945 | B1 | 3/2002 | Losier et al. | |
| 6,615,688 | B2 | 9/2003 | Wessel | |
| D484,755 | S | 1/2004 | Shonfeld et al. | |
| 6,701,828 | B1 | 3/2004 | Burns et al. | |
| 6,752,293 | B2 | 6/2004 | So | |
| D537,344 | S | 2/2007 | O'Brien et al. | |
| D537,722 | S | 3/2007 | Jaichandra et al. | |
| D538,164 | S | 3/2007 | Zach et al. | |
| D539,147 | S | 3/2007 | O'Brien | |
| 7,226,231 | B2 | 6/2007 | Py et al. | |
| 7,520,406 | B2 | 4/2009 | Jaichandra et al. | |
| D592,513 | S | 5/2009 | Zach et al. | |
| D592,527 | S | 5/2009 | Serio et al. | |
| D596,033 | S | 7/2009 | Zach et al. | |
| 2006/0167419 | A1 | 7/2006 | Fiechter et al. | |
| 2007/0007302 | A1* | 1/2007 | Jaichandra et al. | 222/47 |
| 2008/0058239 | A1 | 3/2008 | Evers et al. | |
| 2008/0099041 | A1 | 5/2008 | Evers et al. | |
| 2008/0247805 | A1 | 10/2008 | deVirag et al. | |
| 2009/0215661 | A1 | 8/2009 | Klinkhammer et al. | |
| 2009/0215909 | A1 | 8/2009 | Wortley et al. | |

FOREIGN PATENT DOCUMENTS

| | | | |
|---|---|---|---|
| FR | 2855504 | A1 | 12/2004 |
| WO | 99/38788 | A1 | 8/1999 |
| WO | 2007/008531 | A1 | 1/2007 |
| WO | 2007043092 | A1 | 4/2007 |

* cited by examiner

APPLICATOR FOR AUTOMATICALLY DISPENSING SELF-ADHESIVE PRODUCTS

CROSS-REFERENCE TO RELATED APPLICATIONS

This application is a continuation-in-part of prior application Ser. No. 12/388,588, filed Feb. 19, 2009 now abandoned, which is incorporated herein by reference.

FIELD OF THE DISCLOSURE

In some embodiments, the present disclosure is directed to an ergonomic and user-friendly product applicator.

BACKGROUND OF THE DISCLOSURE

Self-adhesive compositions for use in cleaning applications are a new and exciting technology. For example, the Scrubbing Bubbles® Toilet Gel product that is manufactured and sold by S.C. Johnson & Son, Inc. (Racine, Wis.) provides users with a way to clean and freshen their toilet without the use of a cage, or other device to support the cleaning product. Currently, the Toilet Gel product is dispensed using an applicator which has a button that may be depressed during a simultaneous forward pushing motion. The applicator is described in U.S. Pat. No. 7,520,406.

While the currently-available Toilet Gel product has achieved substantial commercial success in markets around the world, the inventors have surprisingly observed that this product may not have such a wide appeal as it has been discovered that some potential customers may shy away from the product due to confusion over the proper method of use of the applicator, rather than based on applicability of the gel product alone. Even more surprising, such learning comes despite the existing applicator providing a relatively uniform and consistent dose of product. Further, there may be certain limitations to the types of products which may be dispensed with such an applicator.

To address this newly discovered problem, a more simplified dispensing system is described herein.

SUMMARY OF THE DISCLOSURE

In a first nonlimiting embodiment, the present disclosure is directed to a device employed by a user for applying a self-adhesive product to a surface. The device includes an outer housing configured for gripping by a single hand of the user, the outer housing having a distal end, and a volume of self-adhesive product disposed within the outer housing. An automatic dispensing mechanism is disposed within the outer housing and operatively coupled to the outer housing and the volume of self-adhesive product, the automatic dispensing mechanism configured to advance at least a portion of the volume of self-adhesive product through the outer housing distal end in response to a manual actuation force applied to the outer housing.

In a second nonlimiting embodiment, the present disclosure is directed to a device employed by a user for applying a self-adhesive product to a surface. The device includes an inner housing including a proximal end and a distal end, the distal end defining a discharge outlet, an outer housing sized to slidably receive the inner housing proximal end and configured for gripping by a single hand of the user, the outer housing defining a longitudinal axis and having a proximal end and a distal end, and a guide rod having a proximal end coupled to the outer housing proximal end and a distal end extending through the inner housing. A plunger is coupled to the guide rod distal end, wherein movement of the outer housing in a distal direction relative to the inner housing advances the plunger through the inner housing to a distal position. A volume of self-adhesive product is disposed in the inner housing and in contact with the plunger so that at least a portion of the volume of self-adhesive product is advanced through the outer housing distal end in response to a manual actuation force applied to the outer housing.

In a third nonlimiting embodiment, the present disclosure is directed to a device employed by a user for applying a self-adhesive product to a surface. The device includes an inner housing for holding the self-adhesive product, a linking member coupled to the inner housing, and an outer housing configured for gripping by a single hand of the user and sized to slidably receive the inner housing, the outer housing further including a coupling releasably engaging a proximal end of the linking member, the coupling being configured to release the proximal end of the linking member in response to a manual unloading force applied by the user. At least one of the outer housing coupling and the linking member proximal end is positioned for engagement by a thumb of the single hand of the user to apply the unloading force.

BRIEF DESCRIPTION OF THE DRAWINGS

The following detailed description of specific nonlimiting embodiments can be best understood when read in conjunction with the following drawings, where like structures are indicated with like reference numerals and in which.

DETAILED DESCRIPTION

Definitions

Figure 1:
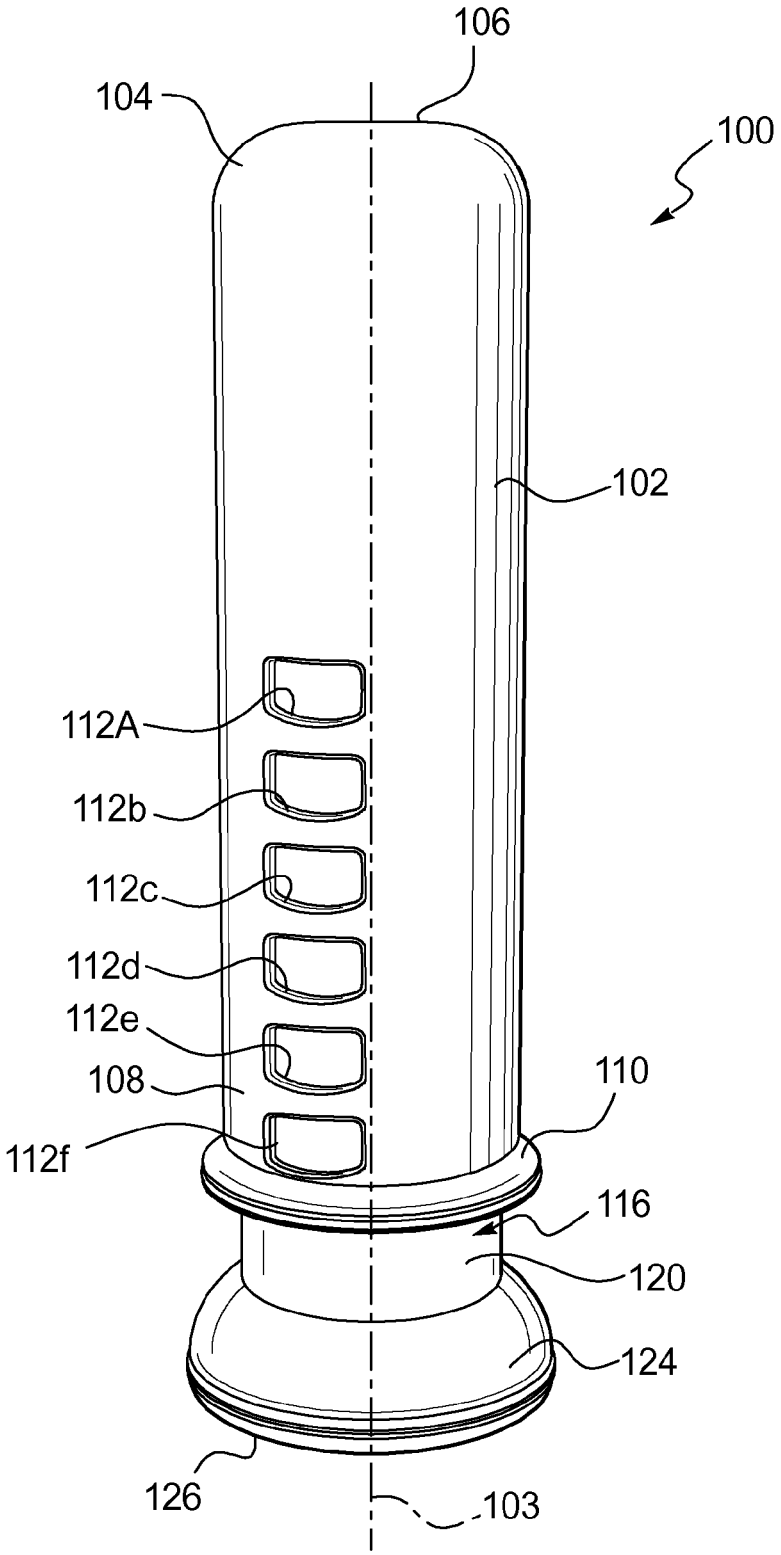
FIG. 1 is a perspective view of an applicator for a self-adhesive product constructed according to the teachings of the present disclosure.

As used herein, "self-adhesive product" refers to any gel, paste, wax, solid, or the like, or combination thereof, that may be adhered to, or otherwise self-supporting from, a surface. A self-supporting product will not require any additional device, or other mechanical means, to maintain and/or support and/or otherwise suspend the product in a fixed place. In some embodiments, there may be gravitational forces acting against the product. For example, a product may be intended to be adhered to the side of a toilet bowl underneath the rim. In some embodiments, the surface is a ceramic surface, such as a toilet bowl or a sink. In other nonlimiting embodiments, a surface may be glass, metal, plastic, stone, and the like. In some embodiments, self-adhesive product expressly does not include a separate layer of glue. It is thought that many types of glue which may be used to provide a means for attachment to a surface will leave an unwanted residue behind on the surface. In some other embodiments, self-adhesive product may be washed away from the surface on which it is adhered without leaving a residue on the surface. In other embodiments, the composition of the product may be substantially uniform throughout. In one embodiment, a product may be washed away from a surface after being subject to one or more flushes.

In a particular embodiment, a self-adhesive product may comprise one or more surfactants. In other embodiments, a self-adhesive product is not required to be placed into a mechanical support unit. In other embodiments still, a self-adhesive product may be a toilet care product. An exemplary self-adhesive product that may be used for toilet care applications is the Scrubbing Bubbles® Toilet Gel product that is available from S.C. Johnson & Son, Inc. (Racine, Wis.). An exemplary mechanical support unit is described in U.S. Des. Pat. No. D423,639. A mechanical support unit may be distinguished from an applicator and/or application device ("device") because, in some embodiments, the product that is being dispensed and/or that is delivering any beneficial effect must be located within, or otherwise used in conjunction with, the support device as it is providing and/or delivering product and/or its beneficial effect.

Self-Adhesive Product: Adhesion and Use Characteristics

In a simplified exemplary embodiment, a self-adhesive product may be any product which may be affixed to a non-horizontal surface, such as the inner surface of a toilet bowl, in a first configuration without the use of a mechanical device and which may be substantially maintained in the first configuration despite exposure to an incidental force, such as from water from a flush.

In one embodiment, a self-adhesive product may be described as any product that, upon being subjected to the "Flush Resiliency Test" described herein, adheres to the surface of the toilet bowl for at least about 5 flushes. In another embodiment, a self-adhesive product adheres to the surface of the toilet bowl for more than at least about 100 flushes. In still another embodiment, a self-adhesive product adheres to the surface of the toilet bowl for more than about 500 flushes. In yet another embodiment, a self-adhesive product adheres to the surface of the toilet bowl for from about 5 flushes to about 1000 flushes. In a different embodiment still, a self-adhesive product adheres to the surface of the toilet bowl for from about 100 flushes to about 1000 flushes. In another embodiment, a self-adhesive product adheres to the surface of the toilet bowl for from about 100 flushes to about 500 flushes.

Regarding the amount of self-adhesive product that may be released or otherwise expended, in some embodiments a self-adhesive product may be one in which there is a loss of from about 0.5% to about 2% of the initial product weight per flush, according to the Flush Resiliency Test.

One of skill in the art may appreciate that the product may have an initial size, shape, weight, density, and have any product distribution, that is suitable for the intended purpose. In one nonlimiting embodiment, the self-adhesive product may have an initial weight of from about 2 g to about 15 g. In another nonlimiting embodiment, the product may have an initial weight of from about 5 g to about 10 g. In some embodiments, the self-adhesive product may have a shape selected from the group of: symmetrical, asymmetrical, round, square, star, heart, triangle, domed, circular, oblong, rectangular, octagonal, hexagonal, pentagonal, the like, and combinations thereof.

Self-Adhesive Product: Product Presentation

A self-adhesive product may be provided in any product form or state that is suitable for the intended application. In some embodiments, a self-adhesive product may be a solid. In solid form, the self-adhesive product may be the result of an extrusion. The product may be malleable. The product may be forcibly adhered to a surface. The product may have a hardness of from about 50 to about 150 tenths of a millimeter according the "Hardness Test" as described herein. An exemplary self-adhesive product in solid form is described in U.S. Pat. Pub. No. US 2008-0190457.

In other embodiments, a self-adhesive product may be a gel. The gel may be formed by a hot melt process. The gel may have a melt temperature of from about 50° C. to about 80° C. The gel may have a viscosity of from about 150,000 cps to about 400,000 cps as measured by a cone and plate viscometer. In some embodiments, a self-adhesive gel product may be able to be self-adhered to both wet and dry surfaces. An exemplary self-adhesive product in gel form is described in U.S. Pat. Pub. No. US 2009-0325839.

Product Presentation: Surface Spreading

As described supra, the disclosed compositions provide the unexpected benefit over existing compositions of, inter alia, increased mobility, active ingredient transport, and stability. Exemplary compositions are made according to the Detailed Description and are tested for surface spreading using the "Surface Spreading Test" described below.

Surprisingly, it is noticed that the addition of the surfactants provide a significant increase in transport of the compositions. In one embodiment, the compositions provide a transport rate factor of less than 55 seconds. In another embodiment, the compositions provide a transport rate factor of less than about 50 seconds. In still another embodiment, the compositions provide a transport rate factor of from about 0 seconds to about 55 seconds. In another embodiment, the compositions provide a transport rate factor of from about 30 seconds to about 55 seconds. In yet still another embodiment, the compositions provide a transport rate factor of from about 30 seconds to about 50 seconds. In still another embodiment, the composition provides a transport rate factor of from about 30 seconds to about 40 seconds.

Product Presentation: Adhesion

In some embodiments, the products disclosed herein may adhere to a solid surface under relatively harsh conditions. It is surprisingly discovered that it may be advantageous for the product to be able to adhere to a surface for a period of at least 5 hours, as measured by the "Adhesion Test" described below. In one embodiment, a product has a minimum adhesion of greater than about 8 hours. In another embodiment, a product has a minimum adhesion of from about 8 hours to about 70 hours.

Applicator

As with the device described in U.S. Pat. No. 7,520,406, many embodiments of the present applicator 100 may be used to accurately apply controlled unitized doses of a self-adhesive composition, flowable material and/or flowable self-adhesive material, to a surface. In one example, the applicator 100 may be used for applying controlled doses of a cleaning, disinfecting and/or fragrancing flowable adhesive gel to the surface of a toilet, urinal, bathtub, shower, or the like. An exemplary self-adhesive product is described in U.S. Pat. No. 6,667,286. An alternative example of a self-adhesive product is described in WO 2009/105233. The products described in U.S. Pat. No. 6,667,286 and WO 2009/105233 may also be considered flowable. In some embodiments, a material may be considered flowable if it may be displaced by a minimum force along one or more sides and/or faces and/or portions of the material and the product. Another nonlimiting example of such a material is described in U.S. Pat. Pub. No. 2007/0007302. In the described embodiments, the product is described to have a viscosity of at least 150,000 cps. In other embodiments, the product has a viscosity of from about 150,000 cps to about 400,000 cps.

FIG. 1 shows one non-limiting embodiment of an applicator 100 for dispensing a self-adhesive product. The exemplary embodiment includes an outer housing 102 ergonomically sized and configured to comfortably fit a user's hand. In the illustrated embodiment, the outer housing 102 has a cylindrical cross-section and extends along a longitudinal axis 103. The outer housing includes a proximal end 104 having an end wall 106 and a distal end 108 that is open. The distal end 108 may include an outwardly projecting flange 110. A series of windows 112*a-f* may be formed in the distal end 108 which permit viewing of an interior space defined by the outer housing 102. While the illustrated embodiment shows six windows, the outer housing 102 may have more than six windows or less than six windows (including no windows). Still further, a single elongate window may be formed in the outer housing 102.

Figure 2:
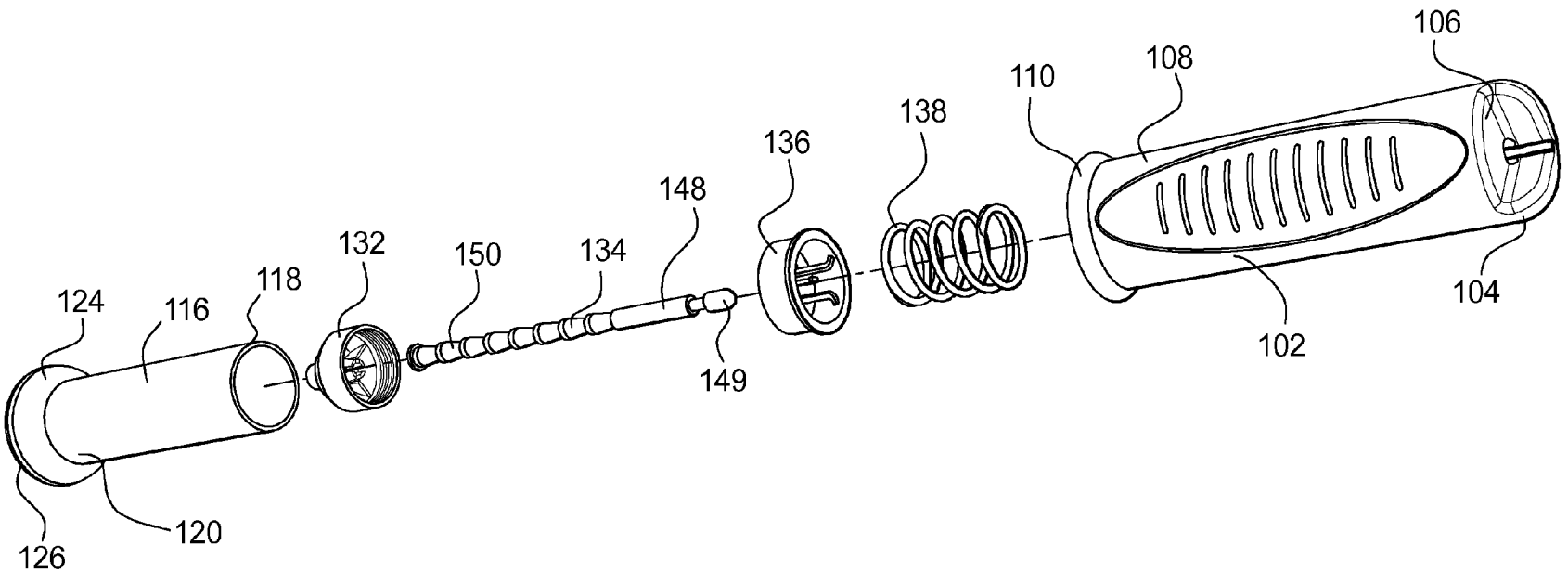
FIG. 2 is an exploded view of the applicator of FIG. 1.

An inner housing 116 is sized for slidable insertion into the interior space of the outer housing 102. As best shown in FIG. 2, the inner housing 116 includes a proximal end 118 and a distal end 120. In the exemplary embodiment, both the proximal and distal ends 118, 120 are open. The distal end 120 defines a discharge outlet 122 (FIG. 3) which may be configured to dispense the self-adhesive product in a desired shape. An outwardly flaring lip 124 may be formed at the distal end 120 which defines a stop which limits travel of the outer housing 102 in a distal direction relative to the inner housing 116. An edge 126 of the lip 124 may be configured to engage the surface, such as a toilet bowl, on which the product is to be deposited. The inner housing 116 further defines an inner chamber 128 in which a volume 130 (FIGS. 6A-C) of self-adhesive product is disposed.

An automatic dispensing mechanism is disposed within the outer housing 102 and operatively coupled to the outer housing 102 and the volume 130 of self-adhesive product. The automatic dispensing mechanism is configured to advance at least a portion of the volume 130, alternatively referred to herein as a dose, of self-adhesive product through the discharge outlet 122 in response to a manual actuation force applied to the 102 outer housing. In the illustrated embodiment, the automatic dispensing mechanism includes a plunger 132, a guide rod 134, an end cap 136, and a spring 138.

The plunger 132 is slidably disposed inside the inner chamber 128. The plunger 132 includes a cylindrical central hub 140 sized to slidably receive the guide rod 134. A front wall 142 extends outwardly from the central hub 140 and has a leading surface 143 for engaging the volume 130 of product disposed in the inner chamber 128. A cylindrical side wall 144 extends from the front wall 142 in a proximal direction. The side wall 144 is sized to sealingly engage the inner surface of the inner housing 116 yet permit sliding movement of the plunger 132 through the inner chamber 128. The plunger 132 further includes one or more flexible locking arms 146 extending from the central hub 140 in a proximal direction. The flexible locking arms 146 may be movable between an inwardly disposed lock position and an outwardly disposed deflected position.

Figure 3:
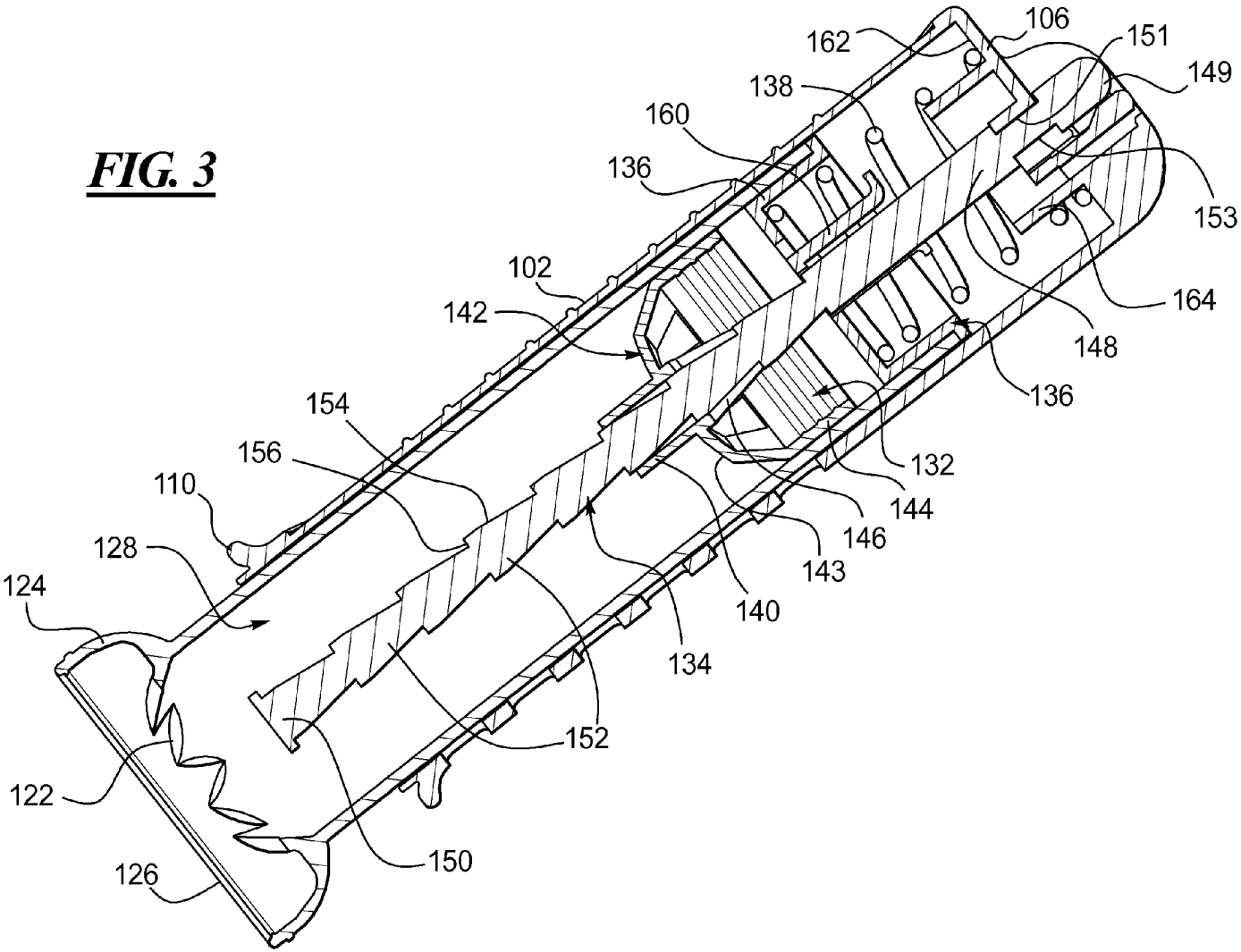
FIG. 3 is a cross-sectional view of the applicator taken along line 3-3 of FIG. 1.

The guide rod 134 includes a proximal end 148 positioned adjacent the outer housing proximal end 104 and a distal end 150 disposed inside the inner housing 116. The guide rod proximal end 148 may define a head 149 that extends proximally through the outer housing end wall 106 (FIG. 3). The outer housing end wall 106 may also include an aperture 151 that releasably engages a recess 153 formed in the guide rod proximal end 148. When the aperture 151 engages the recess 153, the guide rod 134 is fixed to and moves with the outer housing 102.

The guide rod distal end 150 may be slidably coupled to the plunger 132 to permit movement of the guide rod 134 in a single direction with respect to the plunger 132. In the illustrated embodiment, the guide rod 134 includes a plurality of ratchet segments 152. Each ratchet segment 152 may have a frustoconical cam surface 154 and a planar stop surface 156 extending normal to the longitudinal axis 103. The ratchet segments 152 may be oriented with each stop surface facing the distal end of the applicator 100, thereby to permit movement of the guide rod 134 in a proximal direction with respect to the plunger 132 while preventing movement of the guide rod 134 distally relative to the plunger 132. Accordingly, when an actuation force is applied to the guide rod 134 in a distal direction, that force may be transferred to the plunger 132 via the engagement of the locking arms 146 with one of the stop surfaces 156. Conversely, if a return force is applied to the guide rod 134 in a proximal direction, and the plunger 132 is held in place by a retention force, the guide rod 134 will slide in a proximal direction relative to the plunger 132.

Figure 5:
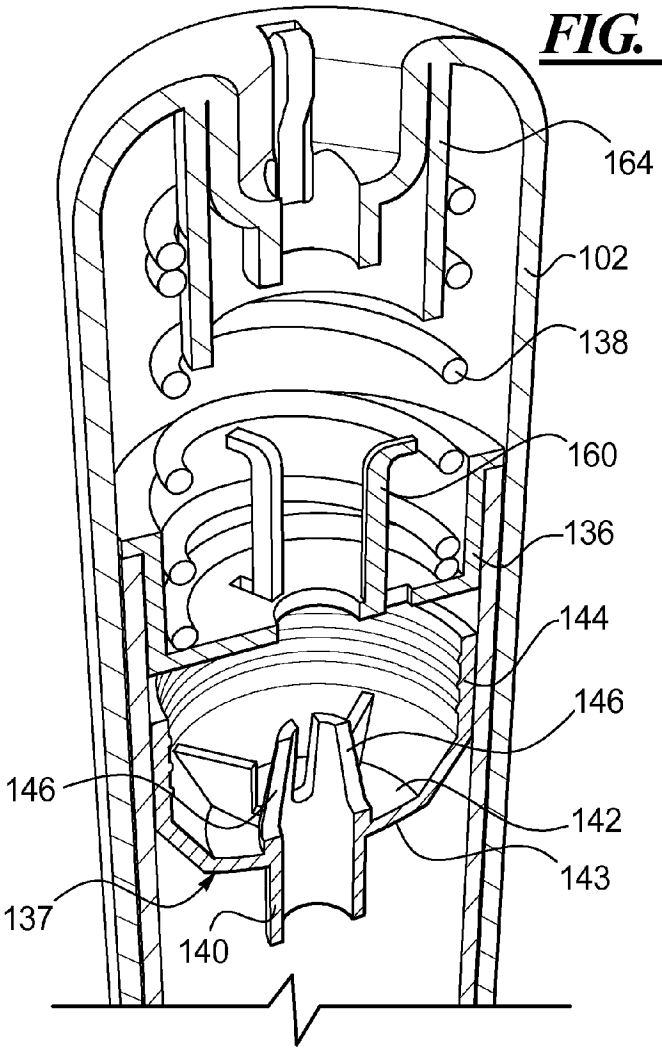
FIG. 5 is an enlarged cross-sectional view of the proximal end of the applicator of FIG. 1 with a guide shaft removed to show additional details.
Figure 4:
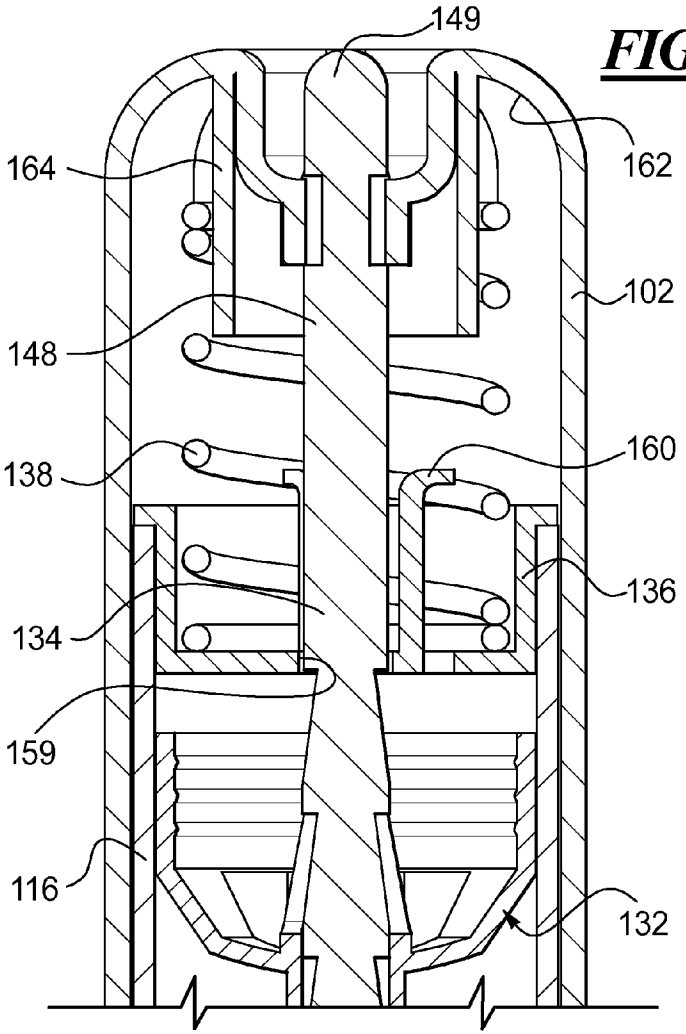
FIG. 4 is an enlarged cross-sectional view of a proximal end of the applicator of FIG. 1.

The end cap 136 is coupled to the inner housing 116 to enclose the proximal end 118 thereof. As best shown in FIGS. 4 and 5, the end cap 136 includes an aperture 159 sized to permit the guide rod proximal end 148 to slide therethrough. The end cap 136 may further include a tab 160 for producing an audible cue, as described in greater detail below.

The spring 138 is disposed between an inner surface 162 of the outer housing proximal end 104 and the end cap 136. A cylindrical wall 164 extends from the outer housing end wall 106 into the outer housing interior space 111 and is sized to hold a proximal end of the spring 138, such as by friction or mechanical engagement. A distal end of the spring 138 engages the end cap 136. The spring 138 provides a spring force which biases the outer housing 102 in a distal proximal direction with respect to the inner housing 116.

Figure 6A:
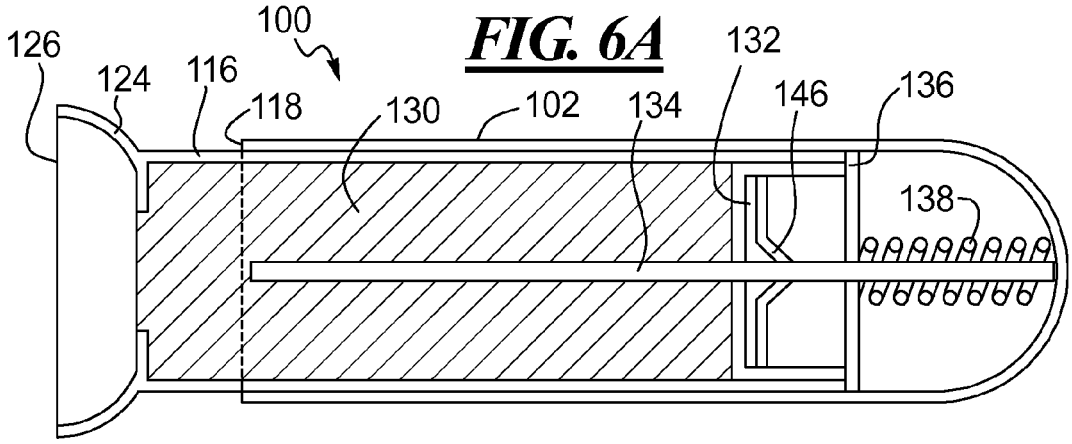
FIGS. 6A-C are simplified cross-sectional views showing the applicator of FIG. 1 in initial, downstroke, and return positions.

In operation, the spring 138 biases the outer housing 102 in an initial or proximal position relative to the inner housing, as best shown in FIGS. 3 and 6A. The user may grasp the outer housing 102 in one hand and position the applicator 100 so that the distal edge 126 of the inner housing engages a surface. Next, the user may apply a manual application force having at least a component that is parallel to the longitudinal axis 103 and in the distal direction (identified by arrow 170 of FIG. 6B) to slide the outer housing 102 distally relative to the inner housing 116 to an actuated position. The outer housing 102 may be prevented from sliding past the actuated position by the outer housing distal end 108 engaging the lip 124 of the inner housing distal end 120.

Figure 6B:
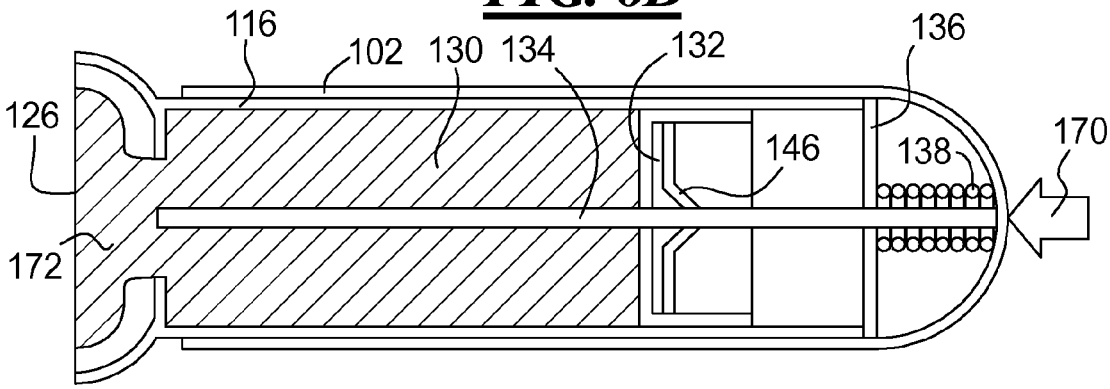

Distal movement of the outer housing 102 is transferred to the guide rode 134, and from the guide rod 134 to the plunger 132, so that the guide rod 134 and plunger 132 also move in a distal direction relative to the inner housing 116, as best shown in FIG. 6B. As the plunger moves from an initial or proximal position to a distal position, it drives the volume 130 of product so that a distal portion or dose 172 of product exits the discharge outlet 122. In the exemplary embodiment, where the product is self-adhesive, the product will automatically adhere to the surface. Additionally, as the outer housing 102 moves to the actuated position, the cylindrical wall 164 may engage the tab 160 to produce an audible noise indicating that the dose of product has been discharged, as best understood with reference to FIGS. 3-5.

Figure 6C:
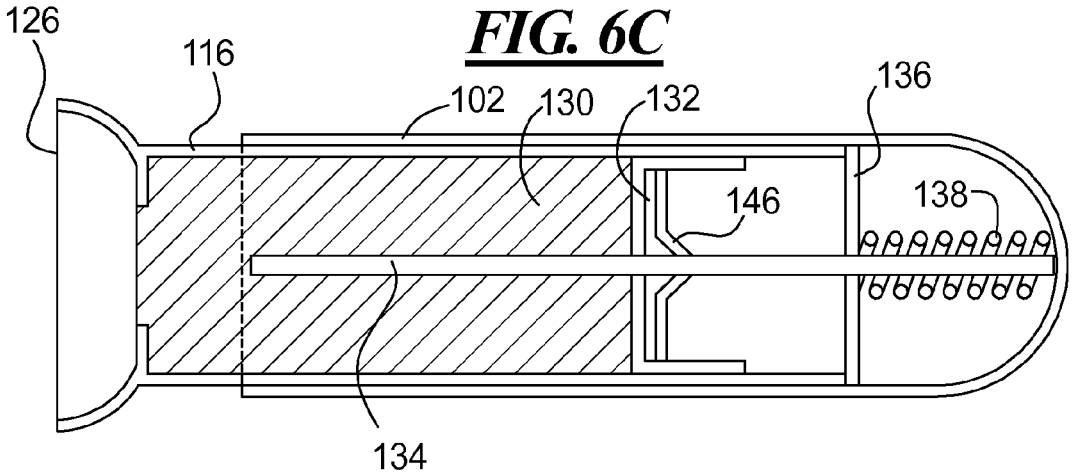
Figure 7:
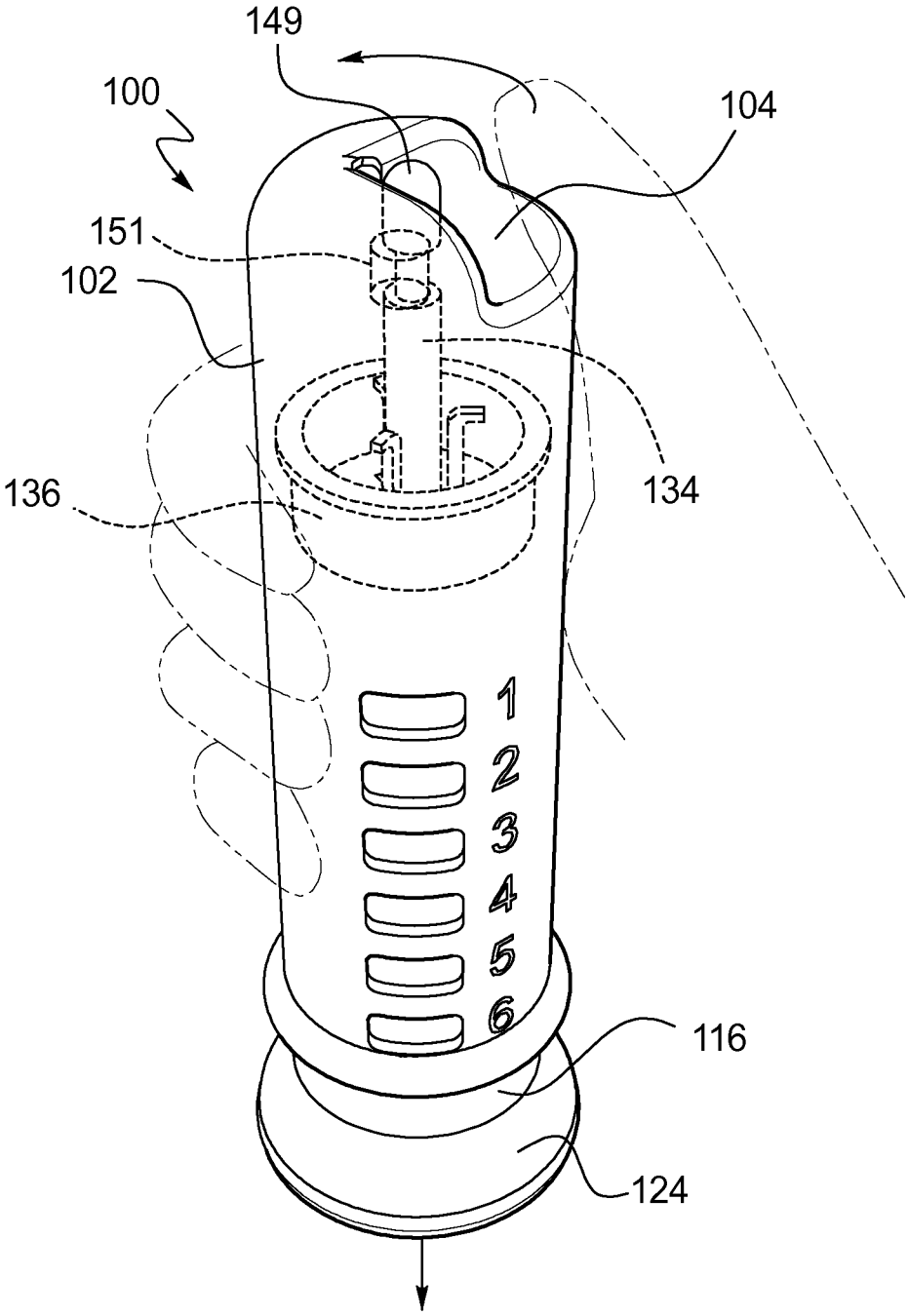
FIG. 7 is a perspective view of the applicator of FIG. 1 performing an unloading operation.

Once the distally directed downstroke is complete, the user may reduce or remove the application force to initial a return stroke, where the outer housing 102 moves from the actuated position to the initial position (FIG. 6C). Once the actuation force is less than the spring force, the spring 138 will drive the outer housing proximally relative to the inner housing 116. Proximal movement of the outer housing 102 will also pull the guide rod 134 in a proximal direction. A retention force may act on the plunger 132, however, to maintain it in place within the inner housing 116. The retention force may include a friction force produced by the friction fit between the plunger 132 and the interior surface of the inner housing 116, the self-adhesive product having a viscosity sufficient to create a vacuum force between the plunger 132 and the self-adhesive product, or other forces and combinations thereof. The retention force may be sufficient to hold the plunger 132 in place while the flexible arms 146 move to the deflected position, thereby to permit the guide rod 134 to move proximally with respect to the plunger 132, as noted above. The arms 146 may slide over the cam surface 154 until they reach the next ratchet segment 152, at which point that may return inwardly to the lock position, after which the above process may be repeated to dispense a subsequent dose of product.

In addition to permitting simple and convenient one-handed product discharge, the applicator 100 also facilitates one handed unloading of a spent volume of product. The outer housing 102 and spring 138 may form a first sub-assembly that may be reused. The inner housing 116, plunger 132, guide rod 134, end cap 136, and volume 130 of product may form a second sub-assembly that may be spent and replaced. The second sub-assembly may be releasably coupled to the first sub-assembly in a manner that permits disengagement of the second sub-assembly using a single hand. More specifically, the guide rod 134 may provide a linking member between the sub-assemblies. The linking member may be releasably coupled to the outer housing 102. In the exemplary embodiment, the aperture 151 formed in the outer housing end wall 104 is configured to disengage from the recess 153 formed in the guide rod proximal end 148 upon application of a distally directed force on the guide rod 134. The guide rod head 149 which projects proximally from the outer housing end wall 104 may be conveniently positioned for engagement by a user's thumb when the user's hand is gripping the outer housing 102, so that a manual unloading force may be directly applied to the guide rod head 149. When the last dose of product has been dispensed, the applicator may be held over a waste receptacle and a sufficient unloading force may be applied to the head 149 to disengage the guide rod 134 from the aperture 151. With the guide rod 134 released, the second sub-assembly (i.e., the inner housing 116, plunger 132, guide rod 134, and end cap 136) may slide out the outer housing distal end 108 to drop into the waste receptacle, while the cylindrical wall 164 retains the spring 138 in place, thereby permitting single-handed unloading of the applicator 100.

The applicator 100 may also permit single-handed loading of a replacement cartridge. The replacement cartridge may be a replacement for the second sub-assembly, and therefore would include an inner housing, plunger, guide rod, end cap, and volume of product. The replacement cartridge may be placed on a support surface so that the inner housing distal end engages the surface and supports the cartridge in an upright position. The outer housing 102 may be grasped by a single hand of the user and slid over the inner housing of the replacement cartridge until the guide rod engages the aperture 151 in the outer housing end wall 106. Thus, a replacement cartridge may be loaded into the outer housing 102 using a single hand.

Figure 8:
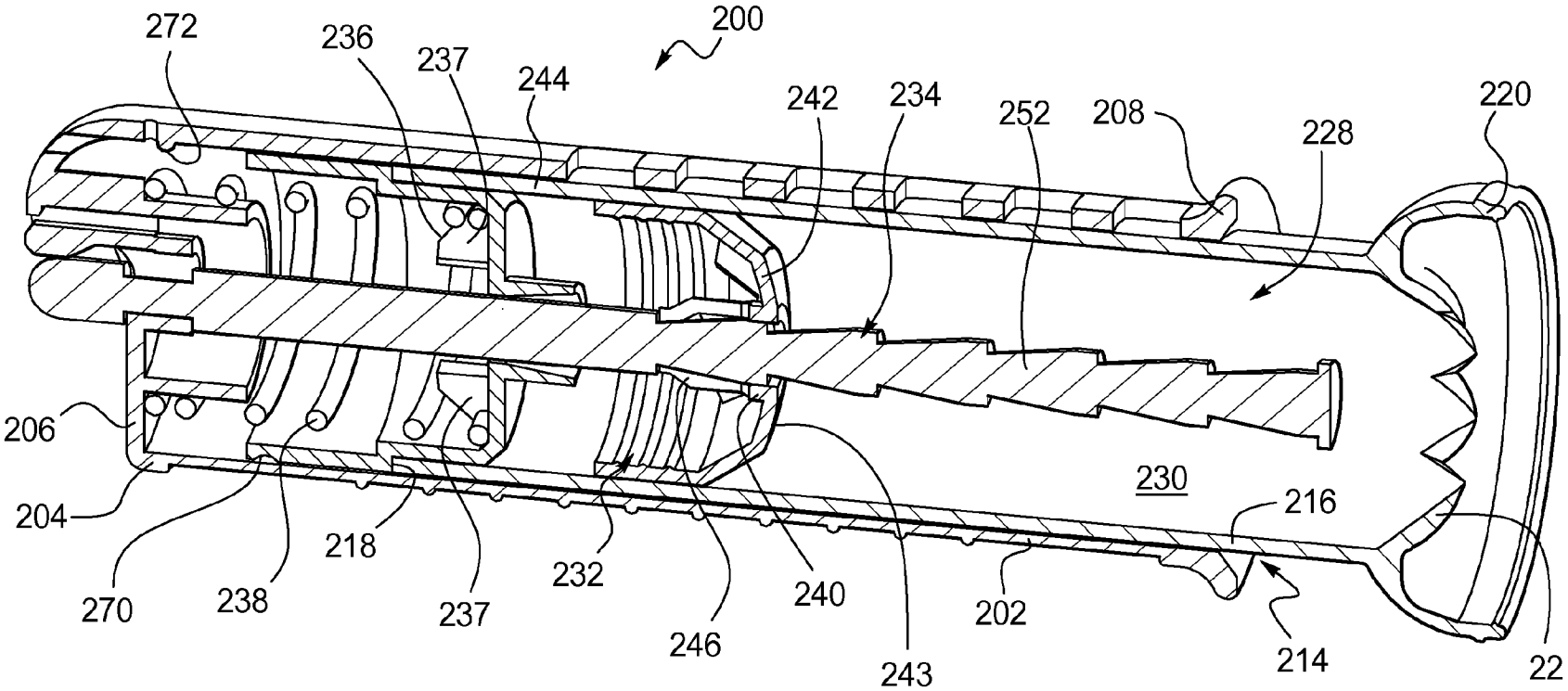
FIG. 8 is a cross-sectional view of an alternative embodiment of an applicator for a self-adhesive product constructed according to the teachings of the present disclosure.

An alternative embodiment of an applicator 200 for dispensing a self-adhesive product is illustrated in FIG. 8. The applicator 200 is similar to the applicator 100 described above, and therefore only the differences of the applicator 200 are described in detail.

The applicator 200 includes an outer housing 202 with a proximal end 204 having an end wall 206 and a distal end 208 that is open. An inner housing 216 is sized for slidable insertion into an interior space 214 of the outer housing 202 and includes a proximal end 218 and a distal end 220 defining a discharge outlet 22. The inner housing 216 further defines an inner chamber 228 in which a volume 230 of self-adhesive product is disposed.

The applicator 200 has an automatic dispensing mechanism including a plunger 232, a guide rod 234, an end cap 236, and a spring 238. The plunger 232 is slidably disposed inside the inner chamber 228 and includes a cylindrical central hub 240 sized to slidably receive the guide rod 234. A front wall 242 extends outwardly from the central hub 240 and has a leading surface 243 for engaging the volume 230 of product disposed in the inner chamber 228. A cylindrical side wall 244 extends from the front wall 242 in a proximal direction. The plunger 232 further includes one or more flexible locking arms 246 extending from the central hub 240 in a proximal direction. The guide rod 234 includes ratchet segments 252 which permit movement of the plunger 232 in a distal direction along the guide rod 234 while preventing movement of the plunger in an opposite, proximal direction.

The spring 238 has a first end coupled to the end wall 206 of the outer housing 202. A second, opposite end of the spring 238 is coupled to the end cap 236. In the illustrated embodiment, the end cap 236 includes proximally extending fingers 237 configured to engage the second end of the spring 238 with a friction or snap fit. Accordingly, the end cap 236 is a reusable part that remains with the outer housing 202 and spring 238, and the plunger 232, guide rod 234 and inner housing 216 are disposable and may be replaced as a unit.

The end cap 236 and outer housing 202 may further be configured to produce an audible cue indicating that a full down- or push-stroke has been executed. In the embodiment of FIG. 8, a recess 270 extends circumferentially around an outer surface of the end cap 236. A projection 272 extends inwardly from an inner surface of the outer housing 202. The recess 270 and projection 272 are located and sized so that an audible noise, such as a clicking sound, is produced when the outer housing 202 has moved relative to the end cap 236 by a given or maximum distance in the distal direction, thereby indicating that the push-stroke is complete and a return- or pull-stroke may be initiated.

Use of Applicator

Single Handed, Thumbs-Free Operation

Even more surprising, it is found that an unexpected benefit of some embodiments disclosed herein is that this device may be actuated with a thumbs-free operation. That is, consumers are not required to use their thumb to depress any buttons. Especially appreciated by consumers is that a simultaneous action of depressing buttons while actuating the device is not required.

One particularly surprising benefit of many embodiments disclosed herein is that the dispensers 100, 200 may be used without the use of a user's thumbs.

Test Methods

Flush Resiliency Test

A high volume toilet bowl (American Standard Cadet Model, American Standard, Piscataway, N.J.) attached to a standard plumbing set-up is used. A water temperature of about 80° F. is used. The water has a "medium" hardness of about 120 ppm $CaCo_3$. About 7 to about 10 g of product is metered out and the initial weight is recorded. The product is then adhered to the inner surface of the toilet bowl, about 2 inches below the upper rim. The toilet is flushed 72 times at approximately equal intervals, approximately every 96 minutes. The remaining product is removed about 30 minutes after the final flush and the weight of the remaining product is recorded. The difference between the final and initial weight is measured and recorded and then divided by the number of flushes. The resultant number is recorded as the "loss per flush". The "loss per flush" may then be divided by the initial weight. The resultant number may be reported as the "loss of initial product weight per flush."

Hardness Test

The method used to assess the hardness of a cleansing block is the "Hardness Test". The hardness measurement is in tenths of a millimeter penetration into the surface of an extrudate. Therefore, a measurement of 150 is a penetration of 150 tenths of a millimeter, or 15 millimeters. The equipment used 20 was a Precision Penetrometer (Serial #10-R-S, Manufactured by Precision Scientific Co., Chicago, Ill., USA) equipped with a large diameter cone weighing 102.4 grams with a 23 D angle, and loaded with 150 grams of weight on the top of the spindle. The test method steps were: (1) Sample must be at least 'X' inches thick. (2) Place sample on the table of the instrument. (3) Both top and bottom 25 surfaces of the test sample should be relatively flat. (4) Set scale on instrument to ZERO and return cone and spindle to the upward position and lock. Clean any residual material off the cone and point before resetting for the next reading. (5) Using hand wheel, lower the complete head of the instrument with cone downward until the point of the cone touches the surface of the sample. (6) 30 Recheck the ZERO and pinch the release of the cone and spindle. (7) Hold the release handle for the count of 10 seconds and release the handle. (S) Read the dial number and record. (9) Repeat steps 4-S three times at different locations on the surface of the test sample. (10) Add the 3 recorded numbers and divide by 3 for the average. This result is the hardness of the tested sample.

With this "Hardness Test", a higher number indicates a softer product because the units of hardness are in tenths of a millimeter in penetration using the 5 test procedure delineated above. If the cleansing block is too soft (i.e., a high hardness number), then it is difficult to manufacture into shapes such as blocks because the product is too malleable. If the product is too hard (i.e., a low hardness number), then more pressure is required to push the cleansing block onto the surface, and some stickiness is lost. Typically a hardness of from about 20 to about 160 tenths of a millimeter penetration may be preferred for a cleansing block that will be applied to a dry surface. Typically a hardness of greater than 50 tenths of a millimeter penetration may be preferred for a cleansing block that will be applied to a wet surface.

Adhesion Test

The ability of a composition to adhere to an exemplary hard surface is measured as described below. A workspace is provided at a temperature of from about 86° F. to about 90° F. The relative humidity of the workspace is set to from about 40% to about 60%.

A board comprising twelve 4.25"×4.25" standard grade while glossy ceramic tiles arranged in a 3 (in the y-direction)×4 (in the x-direction) configuration (bonded and grouted) to a plexi-glass back is provided.

The board is rinsed with warm (about 75° F. to about 85° F.) tap water using a cellulose sponge. The board is then re-rinsed thoroughly with warm tap water. A non-linting cloth (ex. Kimwipe®, Kimberly Clark Worldwide, Inc., Neenah, Wis.) saturated with isopropanol is used to wipe down the entire tile board.

The board is juxtaposed to be in a horizontal position (i.e., such that the plane of the board is flat on the floor or lab bench).

Samples approximately 1.5" in diameter and weighing from about 5.5 g to about 8.0 g are provided to the surface of the board such that the bottom of the sample touches the top-most, horizontally oriented (i.e., in the x-direction), grout line of the board. Samples are spaced approximately 2" apart from each other. A permanent marker is used to draw a straight line (parallel to the x-direction) approximately 0.75" below the top-most grout line.

The board is juxtaposed to then be in the vertical position (i.e., such that the plane of the board is perpendicular with the floor or lab bench). A timer is started as the board is moved to the vertical position. The time that a sample takes for the sample to slide down the tile a distance of about 1.5 times the diameter of the sample is measured, recorded as the "sample adhesion time."

Surface Spreading Method

The "transport rate factor" is measured as described below.

A 12"×12" pane of frosted or etched glass is mounted in a flat-bottomed basin that is large enough to support the pane of glass. The basin is provided with a means for drainage such that water does not accumulate on the surface of the pane of glass as the experiment is performed at a room temperature of approximately 22° C. in ambient conditions. The pane of glass is supported on top of the bottom of the basin of water using 4"×4" ceramic tiles—one tile at each side of the bottom edge of the pane. The middle 4 inches of the pane is not touching the bottom, so that water can run down and off the glass pane. The pane of glass is juxtaposed such that pane of glass is at an angle of approximately 39° from the bottom of the basin.

The glass pane is provided with 0.5 inch measurement markers from a first edge to the opposing edge.

A glass funnel (40 mm long×15 mm ID exit, to contain >100 ml) is provided approximately 3.5" over the 9" mark of the pane of glass.

The pane of glass is cleaned with room temperature water to remove trace surface active agents. The cleaned pane of glass is rinsed until there is no observable wave spreading on the pane.

A sample of approximately 7 g. (approximately 1.5" diameter circle for gels) of composition is applied to the pane of glass at the 0 mark. Four beakers (approximately 200 mL each) of water (are slowly poured over the top of the glass pane at the 9" height point and is allowed to run down the pane of glass to condition the composition.

After about one minute, the funnel is then plugged and is provided with approximately 100 mL of water. An additional 100 mL of water is slowly poured onto the glass pane at approximately the 9" marker. After approximately 10 seconds, the stopper is removed and a timer is started as the water in the funnel drains onto the pane of glass.

A wave on the surface of the draining water film above the composition is observed to creep up the glass and the time for the composition to reach the 5" marker is recorded.

The test is repeated for 10 replicates and the time in seconds is averaged and reported as the "transport rate factor" (time in seconds).

The exemplary embodiments herein disclosed are not intended to be exhaustive or to unnecessarily limit the scope of the claims. The exemplary embodiments were chosen and described so that others skilled in the art may practice the claimed subject matter. As will be apparent to one skilled in the art, various modifications can be made within the scope of the aforesaid description. Such modifications being within the ability of one skilled in the art are intended to fall within the scope of the appended claims.

It is noted that terms like "specifically," preferably," "typically," "generally," and "often" are not utilized herein to limit the scope of the claims or to imply that certain features are critical, essential, or even important to the structure or function of the claimed subject matter. Rather, these terms are merely intended to highlight alternative or additional features that may or may not be utilized in a particular embodiment disclosed herein. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "50 mm" is intended to mean "about 50 mm."

All documents cited in the Detailed Description are, in relevant part, incorporated herein by reference; the citation of any document is not to be construed as an admission that it is prior art. To the extent that any meaning or definition of a term in this written document conflicts with any meaning or definition of the term in a document incorporated by reference, the meaning or definition assigned to the term in this written document shall govern.

We claim:

1. A device employed by a single hand of a user for applying a self-adhesive product to a surface, the device comprising:

an inner housing including a proximal end and a distal end, the distal end defining a discharge outlet;

an outer housing sized to slidably receive the inner housing proximal end and configured for gripping by a single hand of the user, the outer housing defining a longitudinal axis and having a proximal end and a distal end;

a guide rod having a proximal end coupled to the outer housing proximal end and a distal end extending through the inner housing;

a plunger coupled to the guide rod distal end, wherein movement of the outer housing in a distal direction relative to the inner housing advances the plunger through the inner housing to a distal position;

a volume of self-adhesive product disposed in the inner housing and in contact with the plunger so that at least a portion of the volume of self-adhesive product is advanced through the outer housing distal end in response to a manual actuation force applied to the outer housing; and wherein a proximal end wall of the outer housing includes an aperture through which the guide rod projects, the guide rod including a head positioned proximally of the aperture in the end wall, and wherein the aperture is configured to release the guide rod in response to an unloading force applied by the single hand of the user simultaneously gripping the outer housing to the rod head.

2. The device of claim 1, in which the outer housing defines a longitudinal axis, and in which the manual actuation force includes at least a force component parallel to the outer housing longitudinal axis.

3. The device of claim 1, further including a spring disposed between the outer housing and the inner housing and defining a spring force, the spring configured to hold the outer housing at an initial position relative to the inner housing, wherein the actuation force is greater than the spring force to drive the outer housing to an actuated position relative to the inner housing, thereby moving the plunger to the distal position.

4. The device of claim 1, in which the guide rod includes a plurality of ratchet segments, each ratchet segment having a cam surface and a stop surface, and in which the plunger includes arms biased toward a lock position, in which the arms engage the stop surface, but movable to a deflected position, in which the arms are slidable over the cam surface.

5. The device of claim 1, in which the self-adhesive product is a cleaning product.

6. A device employed by a user for applying a self-adhesive product to a surface, the device comprising:

an inner housing for holding the self-adhesive product;

a linking member coupled to the inner housing; and an outer housing configured for gripping by a single hand of the user and sized to slidably receive the inner housing, the outer housing including a proximal end wall through which a proximal end of the linking member projects, the outer housing further including a coupling releasably engaging the proximal end of the linking member, the coupling being configured to release the proximal end of the linking member in response to a manual unloading force applied by the single hand of the user simultaneously gripping the outer housing;

wherein at least one of the outer housing coupling and the linking member proximal end is positioned for engagement by a thumb of the single hand of the user to apply the unloading force and thereby release proximal end of the linking member.

7. The device of claim 6, in which the linking member comprises a guide rod.

8. The device of claim 7, in which the coupling comprises an aperture formed in a proximal end of the outer housing sized to releasably engage the guide rod and the guide rod includes a head positioned proximally of the aperture for engagement by the thumb.

9. The device of claim 6, in which the self-adhesive product is a cleaning product.

10. A device employed by a user for applying a self-adhesive product to a surface, the device comprising:

an inner housing for holding the self-adhesive product;

a linking member coupled to the inner housing;

an outer housing configured for gripping by a single hand of the user and sized to slidably receive the inner housing, the outer housing including a proximal end wall through which a proximal end of the linking member projects, the outer housing further including a coupling releasably engaging the proximal end of the linking member, the coupling being configured to release the proximal end of the linking member in response to a manual unloading force applied by the single hand of the user simultaneously gripping the outer housing;

at least one of the outer housing coupling and the linking member proximal end is positioned for engagement by a thumb of the single hand of the user to apply the unloading force and thereby release proximal end of the linking member; and wherein the coupling comprises an aperture formed in a proximal end of the outer housing sized to releasably engage the linking member and the linking member includes a head positioned proximally of the aperture for engagement by the thumb.

* * * * *